United States Patent [19]

Lamb

[11] 3,964,740

[45] June 22, 1976

[54] SHEET-FEEDING APPARATUS

[76] Inventor: Reginald T. Lamb, 1491 Jopar Ave., Los Altos, Calif. 94022

[22] Filed: Jan. 13, 1975

[21] Appl. No.: 540,314

[52] U.S. Cl. ..... 271/11; 221/259; 271/103; 271/106; 271/107; 271/112; 271/116; 271/161; 271/251

[51] Int. Cl.[2] ..... B65H 3/06; B65H 3/08; B65H 9/16

[58] Field of Search ..... 271/103, 112, 106, 107, 271/93, 116, 251, 161, 94, 11–13, 37; 214/8.5 D, 8.5 H; 221/211, 259 X

[56] References Cited

UNITED STATES PATENTS

| | | | |
|---|---|---|---|
| 2,168,394 | 8/1939 | Coleman et al. | 271/251 X |
| 3,039,767 | 6/1962 | Staines | 271/103 |
| 3,391,926 | 7/1968 | Jaatinen | 271/112 |
| 3,545,741 | 12/1970 | Porth | 271/146 X |
| 3,620,527 | 11/1971 | Tyler et al. | 271/112 |
| 3,652,083 | 3/1972 | Bosshardt | 271/116 |
| 3,764,133 | 10/1973 | Gray et al. | 271/103 |

OTHER PUBLICATIONS

Barna, T., "Vacuum Foot Separator", IBM Technical Disclosure Bulletin, vol. 7, No. 2, July 1964, pp. 138, 139.

*Primary Examiner*—Evon C. Blunk
*Assistant Examiner*—Bruce H. Stoner, Jr.

[57] ABSTRACT

A sheet-feeding apparatus for separating and feeding sheets of paper, cardboard, metallic and plastic material and the like individually from a stack of such sheets is described. The apparatus as described is provided with a curved sheet-receiving chute for containing and temporarily storing a stack of sheets. A chamber having an apertured movable wall is provided adjacent the stack of sheets. The movable wall is positioned and freely movable to contact the top sheet of the stack. A low-pressure blower is provided for evacuating air from the chamber and drawing the top sheet into sealing contact with the movable wall about the aperture. Sealing of the aperture creates a partial differential pressure which moves the wall, reducing the volume of the chamber and removing the top sheet from the stack. Means, such as a roller, is also provided within the chamber. The roller extends slightly through the aperture to contact the sheet once the sheet is removed from the stack. Thereafter and upon command, the roller is moved for translating the sheet longitudinally and transversely and thus aligning and positioning the sheet for subsequent pickup and removal from the apparatus. When the sheet is removed from the apparatus, the aperture in the movable wall is opened and the wall falls automatically to pick up the next sheet.

21 Claims, 12 Drawing Figures

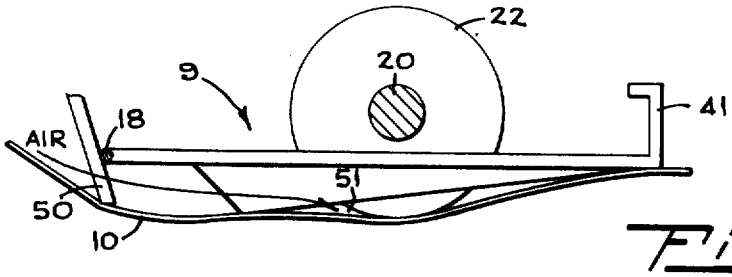
Fig-9
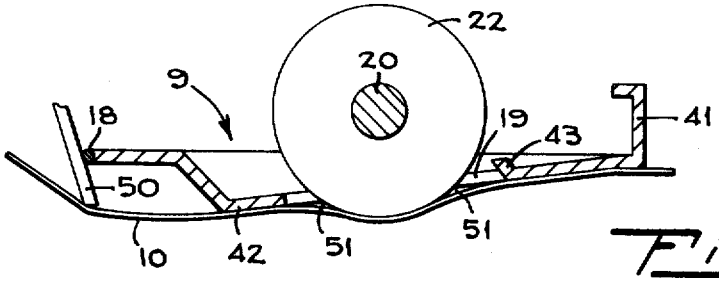
Fig-10
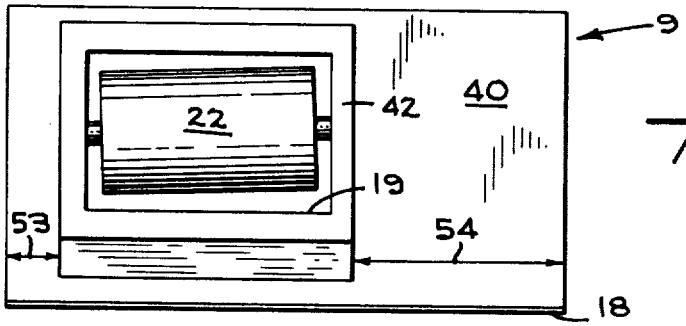
Fig-11
Fig-12
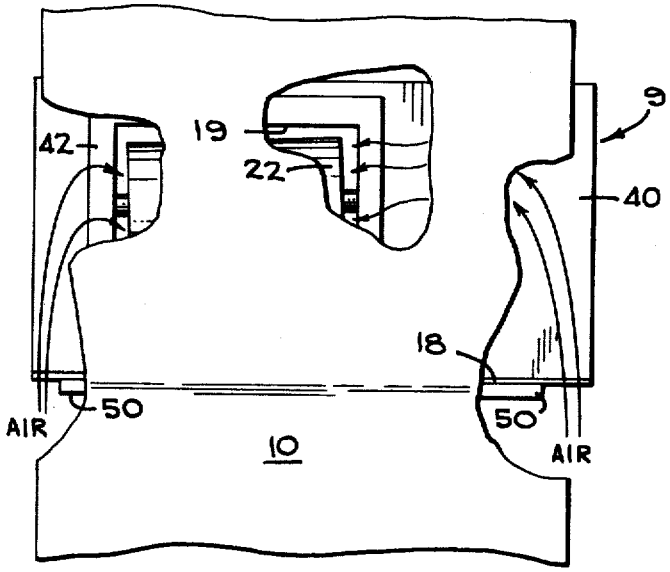

SHEET-FEEDING APPARATUS

BACKGROUND OF THE INVENTION

The present invention relates to sheet-feeding apparatus in general and more particularly to an improved sheet-feeding apparatus for automatically separating sheets of material individually from a stack of such sheets and translating them to a predetermined position for further processing within the apparatus or in another machine.

While having wide applicability for use in processing sheets of various types, sizes and materials, such as paper, cardboard, metallic and plastic material and the like, the present invention is particularly suitable for feeding paper sheets into facsimile and office copier equipment.

Presently, a variety of paper stock is available and used by office personnel in such machines. The paper stock may vary widely in its stiffness, thickness, porosity, weight and surface characteristics. Zinc oxide coated paper, for example, which is used in many office copiers, is particularly awkward and difficult to handle in sheets because of its rough surface, stiffness and weight. It and sheets of other types of paper also have a tendency to cling together because of moisture, static electricity and the like. These characteristics, separately or together, frequently result in making it difficult to automatically, as well as manually, separate a single sheet of paper from a stack of such sheets.

On occasion, it may be desirable to load a machine with paper sheets of varying widths. On other occasions, office personnel may inadvertently misalign a fresh stack of sheets with respect to a remaining stack of sheets when replenishing a supply of stock in a machine. These circumstances also lead to difficulties in paper handling and may result in jamming of the machine.

The two basic functions of a sheet-feeding machine are to separate the first or top sheet in a stack from others in the stack, particularly from the second sheet with which it is in contact and to move the selected sheet to a predetermined desired position.

Two principal methods are presently employed for separating a top sheet from a second sheet. The first of these methods involves the application of a moving frictional surface to the top of the first sheet to slide it off the second sheet. This method is unreliable, however, because surface friction forces vary widely between various types of paper, and the driving friction applied to the top sheet may be less than that between the top sheet and the second sheet so that the second sheet remains fixed to the top sheet. In other instances, the friction between the top sheet and second sheet may exceed that existing between two other sheets in the stack, and the stack will separate at the lower friction interface so that all sheets above that point will feed together. Also, residual moisture or electrostatic attraction may be sufficient to stick the top two sheets of a stack so tightly that they are fed together. Zinc oxide paper, for example, because of its weight, relatively rough surface and the other problems mentioned, is particularly difficult to slide off a second sheet unless the top sheet is first lifted to separate them.

Thus, the second principal method of separating and moving sheets involves lifting the top sheet to separate it from the second sheet before attempting to slide it off the second sheet. For this purpose, vacuum cups and the like have been employed. The difficulty in such prior known apparatus, however, is that the second sheet still frequently follows the top sheet. This is due to the application of part of the lifting force to the second sheet as well as to the top sheet when, for instance, the top sheet is slightly porous. Under these circumstances, the vacuum may act strongly enough on the second sheet to lift it also. In addition, air rushing around the edges of the top sheet in such prior known equipment is frequently strong enough to lift the second sheet.

To avoid the problems associated with the use of friction belts, rollers and the like and the problems associated with prior known vacuum type sheet-feeding apparatus, more recent equipment has employed the use of adhesive fingers or arms for grasping a top sheet from a stack. While avoiding or reducing many of the aforementioned problems associated with prior known sheet-feeding apparatus, the newer equipment is, however, relatively costly to manufacture, operate and maintain by virtue of its complexity, and the need for continual cleanliness, and sufficient adhesiveness to perform its separating function.

In general, most, if not all, prior known sheet-feeding apparatus require time-consuming and skilled adjustments for the handling of sheets of differing material characteristics and sheet sizes as well as routine maintenance.

SUMMARY OF THE INVENTION

For the foregoing reasons, a principal object of the present invention is an improved sheet-feeding apparatus which is simple, reliable and relatively inexpensive to manufacture, operate and maintain.

It is another object of the invention to provide a mechanism which reliably feeds one page at a time regardless of the intermixture of sheets of varying types with different thickness, stiffness, porosity, and surface friction.

It is a further object of the invention to provide a machine which is simple to operate because it requires no adjustments to handle the full range of sheet material usually found in an office.

It is a further object of the invention to provide a mechanism whose parts operate at low stresses and hence show little wear after long use.

It is a further object of this invention to provide a means of lifting the top sheet without also lifting the second sheet.

Still another object of this invention is to provide a machine which is compact and which is readily adaptable for use with a wide variety of document processing equipment.

Yet another object of this invention is to provide a machine wich is self-sequencing in that as each sheet is withdrawn, it automatically selects the next sheet and presents it to the processing equipment without the need for a separate command.

In accordance with the above objects, a principal feature of the improved sheet-feeding apparatus of the present invention is a low-pressure vacuum-operated mechanism for lifting a top sheet from a stack of sheets. The mechanism is characterized in that it comprises a chamber to which a low-pressure blower is coupled for evacuating air from the chamber. One wall of the chamber is freely movable and is provided with an enlarged aperture. Upon the initiation of a cycle of operation, the wall is in contact with the top sheet of a stack of sheets. The evacuation of air from the chamber draws the top sheet into contact with the wall about the periphery of the aperture, sealing the aperture sufficiently to cause a partial vacuum in the chamber. The resulting partial differential pressure causes the wall to move into the chamber reducing its volume and removing the top sheet from the stack. A friction roller or the like is provided in the chamber to contact the sheet through the aperture after it has been raised a predetermined amount from the stack. Upon command, a motor coupled to the roller rotates the roller for moving the sheet forwardly a predetermined distance.

To further facilitate separation of the top and second adjacent sheets, means are also provided for curving the stack of sheets and for further bending the top sheet as it is lifted from the stack.

To justify successive sheets, sheet-guiding means and means for moving the sheets along the sheet-guiding means are also provided to insure that a corresponding edge of each sheet is properly positioned irrespective of the width or initial alignment of the sheets in the machine.

In practice, when a sheet is removed from the machine after separation and the aperture in the movable wall is opened, the vacuum in the chamber is reduced and the wall freely and automatically returns to engage the next succeeding sheet in the stack.

DESCRIPTION OF THE DRAWINGS

The above and other objects, features and advantages of the present invention will become apparent from the following detailed description and accompanying drawings in which

FIG. 9 is an enlarged partial side elevation view of the apparatus of FIG. 8.

FIG. 10 is an enlarged partial cross-sectional view of the apparatus of FIG. 9.

FIG. 11 is a bottom view of the apparatus of FIG. 10.

FIG. 12 is a bottom view of the apparatus of FIG. 11 showing the air flow between a top sheet and the apparatus after separation of the sheet from a stack of sheets.

DETAILED DESCRIPTION

Figure 1:
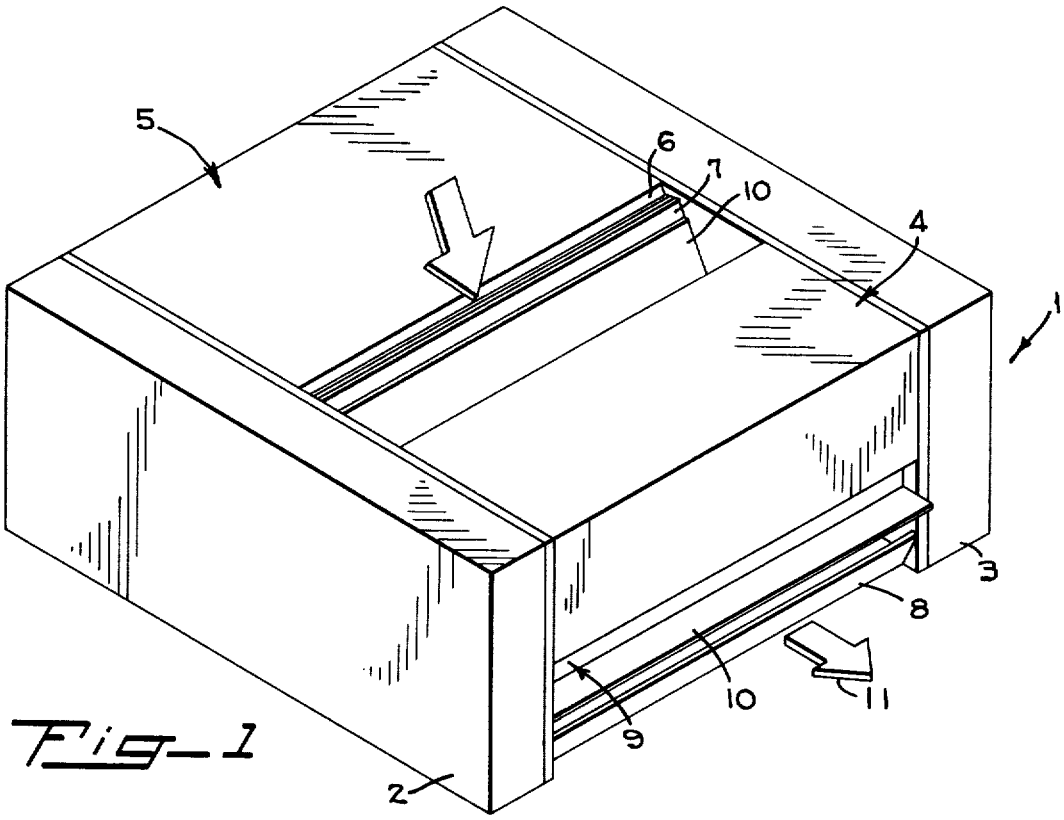
FIG. 1 is an isometric view of an apparatus incorporating the features of the present invention.

Referring to FIG. 1, there is provided in accordance with the present invention an improved sheet-feeding apparatus designated generally as 1, having a pair of side chambers 2 and 3, a vacuum chamber 4 and a motor and blower housing 5. Chamber 4 and housing 5 are located between chambers 2 and 3 at the front and rear of apparatus 1, respectively. Extending from between chamber 4 and housing 5 from the top of apparatus 1 into and forwardly in an arcuate fashion there is provided a sheetreceiving chute 6 for receiving and containing a stack of paper sheets 7. At the front edge of chute 6 there is provided an upstanding lip 8 for engaging and restricting forward movement of the stack 7. As will be described in more detail below, chamber 4 is provided with at least one movable wall 9 for engaging and picking up successive first or top sheets 10 from the stack 7. In addition, means are also provided for translating the sheets picked up in the direction of the arrow 11.

Figure 2:
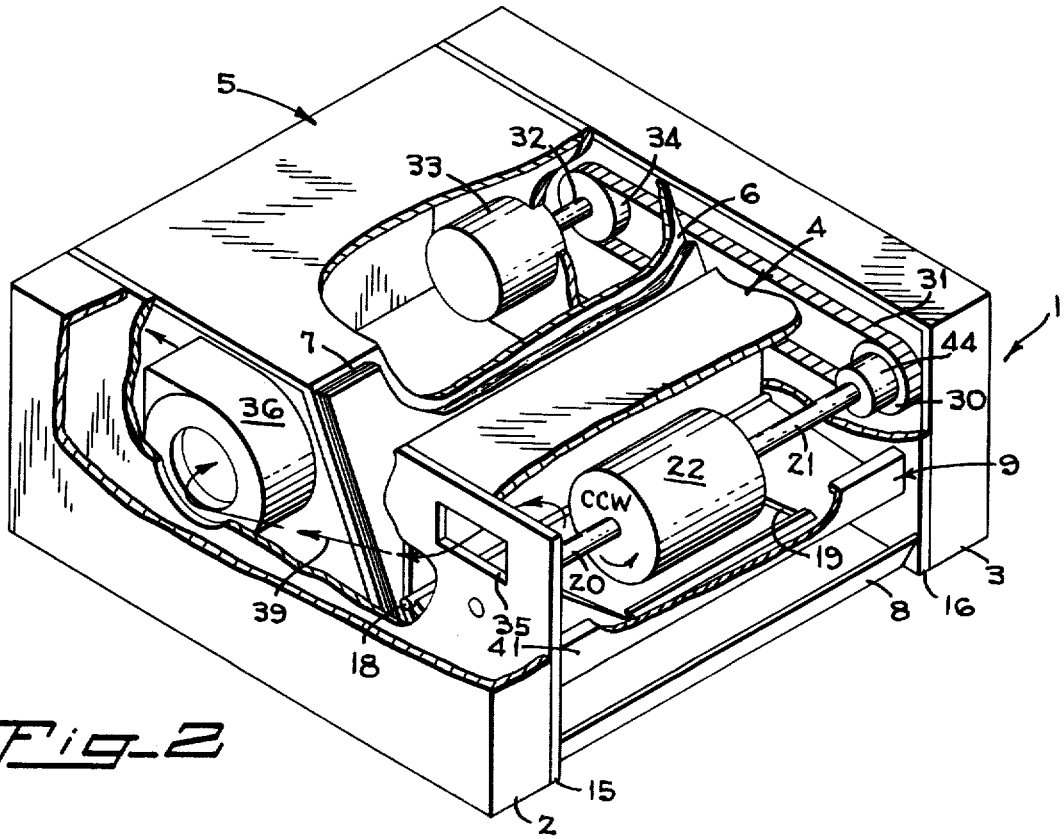
FIG. 2 is a partially broken away view of the principal features of the apparatus of FIG. 1.
Figure 3:
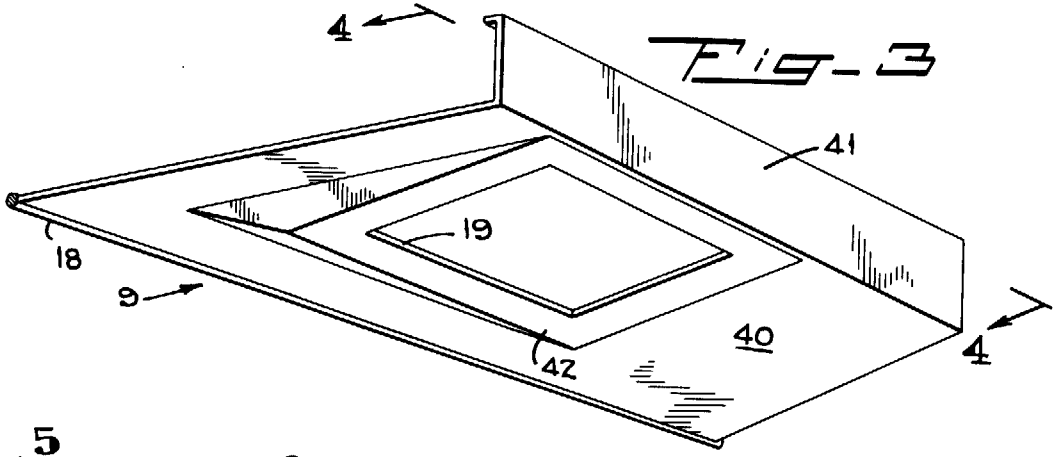
FIG. 3 is a bottom isometric view of the movable wall of the vacuum chamber in the apparatus of FIG. 2.

Referring to FIG. 2, chamber 4 is provided with a pair of side walls 15 and 16. Walls 15 and 16 also serve as a portion of the interior walls of chambers 2 and 3, respectively. Movable wall 9 is pivotably coupled to the lower rear edge of the chamber 4 as by a hinge member 18. Located in a portion of the wall 9 there is provided a rectangularly-shaped aperture 19. Supported within chamber 4 above aperture 19 on a pair of shafts 20 and 21 is a roller 22. Roller 22 is driven by a motor 33 located in housing 5. A shaft 32 of motor 33 is coupled to the shaft 21 of roller 22 by means of a pulley 30, a belt, chain or the like 31 and a pulley 34 located in the chamber 3. To permit counter-clockwise rotation of roller 22 independently of pulley 30, there is further provided intermediate shaft 21 and pulley 30 an overrunning clutch mechanism 44.

In side wall 15 separating chambers 2 and 4 there is provided at one end of chamber 2 an air passageway or aperture 35. At the opposite end of chamber 2 and with its air input in communication therewith there is provided a high-volume, low-pressure blower 36 which is located in housing 5. As shown by the arrows 39, blower 36 evacuates air from chamber 4 through aperture 35 and chamber 2.

As shown in more detail in FIGS. 3–6, the movable wall 9 of chamber 4 is provided with a planar surface 40, from which extends an upstanding flange portion 41. Rearwardly of flange 41 there is provided, extending downwardly from surface 40, a sloping protuberance 42 in which is located the previously described aperture 19. The hinge member 18 of wall 9 extends along the rear margin of surface 40. As seen more clearly in FIG. 6, there is also provided along the forward edge of aperture 19 an inwardly directed lip 43. Lip 43 serves to deflect any stack of papers 7 downwardly and thereby prevents jamming of the machine when a fresh stack 7 is inserted in the chute 6. The angular position of the plane of aperture 19 and hence the slope of protuberance 42 relative to the planar surface 40 is chosen such that the plane of aperture 19 is approximately parallel to the plane of the stack 7 when the wall 9 is in its lowest or first initial position, as will be described.

An important feature of the wall 9 is the size, depth and position of the protuberance 42 and aperture 19 relative to the planar surface 40. As will be noted, the protuberance 42 and aperture 19 extend only partially across the surface 40. The restricted lateral extent and position of the protuberance 42 and aperture 19 permit using paper sheets of varying widths but, more importantly, provide an air gap along the lateral edges of the protuberance between a sheet picked up by the wall and the surface 40. As will be apparent, this air gap prevents the picking up of more than one sheet at a time from the stack of sheets 7 as would otherwise occur due to air flowing vertically along the edges of the stack. As will be described with respect to FIGS. 9 and 10, the precise width of protuberance 42, however, is not critical so long as the air gap described is sufficient to prevent picking up more than a single sheet at a time.

As described with respect to FIG. 1, paper-receiving chute 6 extends downwardly in the interior of apparatus 1 and forwardly in an arcuate fashion. This is seen more clearly in FIG. 7. The curved shape of chute 6 causes a stack of sheets 7 inserted in the machine to assume a curved relationship with respect to the movable wall 9. The curvature thus imparted to the stack 7 is found to facilitate separation of the top sheet from the second and remaining sheets. To further facilitate the separation of the top sheet from the second sheet, there is also provided a downwardly-extending sheet-bending lip 50. Lip 50 is located in the vicinity of the hinge member 18 but extends only partially across the width of chamber 4. The restricted lateral extension of lip 50 is provided for further facilitating the previously described air flow in the gap between the sheet 10 and surface 40 along the lateral edges of the protuberance.

Figure 7:
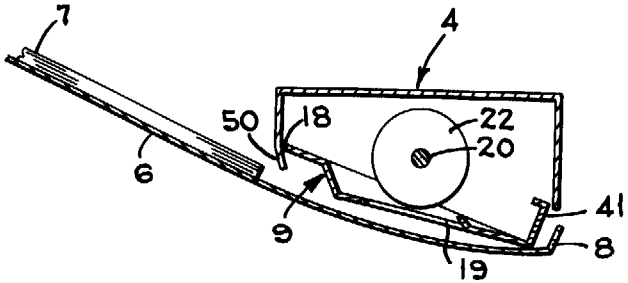
FIG. 7 is a partial cross-sectional view taken parallel to the longitudinal axis of the apparatus of FIG. 1 through the center of the wall of FIG. 3 with the wall in its lowest or first position.
Figure 8:
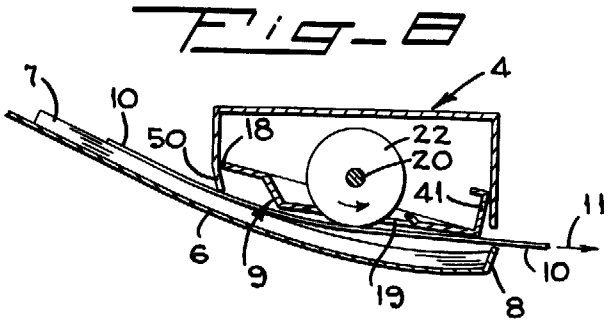
FIG. 8 is a second view of the apparatus of FIG. 7 with the wall in its highest or second position after separation of a top sheet from a stack of sheets.

For purposes of explaning the operation of apparatus 1, reference may be made initially to FIG. 7, which shows the forward edge of wall 9 in a first position in contact with chute 6. Actually, physical contact with chute 6 is not essential, but wall 9 should be movable, close enough to pick up each sheet in the stack 7. As will be apparent, wall 9 moves downwardly to its initial or first position, as shown in FIG. 7, under the force of gravity and upwardly to its second position under the force of a partial differential air pressure created by blower 36, as shown in FIG. 8. The forward upstanding lip 41 of wall 9 is positioned to serve as a sealing member by virtue of its proximity to the adjacent interior surface of chamber 4. A perfect or air-tight seal is not essential as the apparatus in general and blower 36 in particular are designed to operate on high volume and low pressure and hence readily accommodate normal air leakage about the edges of the movable parts without any significant adverse effect.

Thus, initially, a stack of paper sheets 7 is inserted in apparatus 1, as shown in FIG. 7. The stack is inserted until its forward edge abuts the lip 8 of the chute. To prevent premature pickup of the top sheet, blower 36 is generally not running when the stack is inserted.

Once stack 7 is in position and blower 36 is turned on, the top sheet 10, as shown in FIG. 8, will be drawn into sealing contact with wall 9 about the aperture 19 due to the evacuation of air from the chamber 4. Once the seal about aperture 19 is made, the continued evacuation of air from chamber 4 will result in a partial vacuum in the chamber. The resulting partial differential pressure will force the wall 9 and the top sheet 10 upwardly from its first position on the stack to a second position. As the sheet 10 is moved upwardly to its second position, the sheet-bending lip 50 contacts the sheet and adds a further bending distortion to the sheet, further facilitating separation of the sheet from the next succeeding sheet. An important feature of this distortion is that it is not transmitted to the remaining sheets in the stack. At the same time or shortly thereafter, continued upward movement of the wall and top sheet results in the top sheet being brought into contact with roller 22, which then extends slightly through the aperture 19. Once there, the sheet 10 will remain in the last described second position until motor 33 is activated by a command signal.

The command signal to advance motor 33 may be generated automatically internally within the apparatus 1 or, as is generally the case, it may be generated by an external source coupled to the apparatus 1. In either event, upon receipt of a command signal by motor 33, roller 22 will be advanced counterclockwise and translate the top sheet 10 to a predetermined distance in the direction of the longitudinal axis of the apparatus, as illustrated in FIGS. 2 and 8 by the arrow 11.

Figure 5:
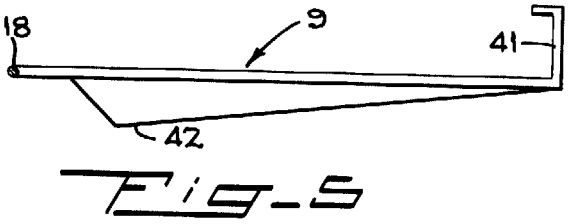
FIG. 5 is a side elevation view of the wall of FIG. 4.
Figure 4:
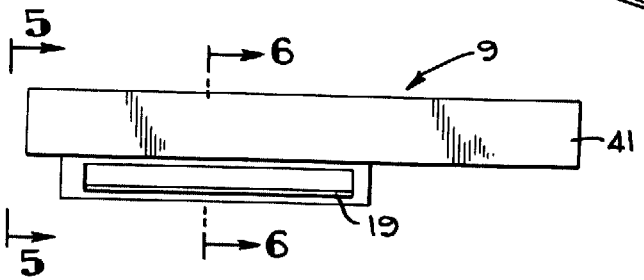
FIG. 4 is a front elevation view of the wall of FIG. 3.
Figure 6:
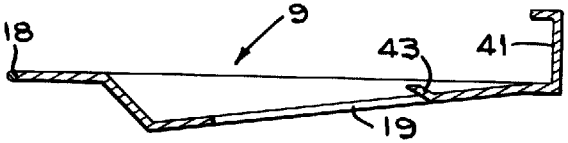
FIG. 6 is a cross-sectional view taken along lines 6—6 of FIG. 4.

Referring to FIGS. 8–10, it will be further noted that, as sheet 10 is brought into contact with roller 22 and the roller is caused to extend slightly through aperture 19, the sheet 10 will be bowed slightly causing the seal between the sheet and the wall 9 to be broken and an air gap or passageway 51 to be formed along the lateral edges of the aperture 19. Upon formation of the gap 51, air will be admitted into chamber 4 predominantly from the gap between the sheet 10 and surface 40 and only to a limited extent from along the lateral edges of the sheets remaining in the stack 7. This prevents the latter predominantly vertical air flow from along the edges of the stack from having an effect on the second sheet sufficient to raise the second sheet. Thus restricted, the lateral extent of the protuberance 42 and the resulting pair of relatively wide margins 53 and 54 along both edges, as seen in FIG. 11, coact, together with the depth of protuberance 42, as seen in FIGS. 4–6, to effect a diffusion of air flow and a reduction of the pressure gradient along the lateral edges of the stack 7 as more clearly illustrated by the arrows in FIGS. 9 and 12. By a judicious selection of the dimensions of the protuberance 42 and aperture 19 relative to the overall size of wall 9, it is found in practice that wall 9 with the sheet 10 in contact therewith will rise automatically to a level sufficient for the forward edge of the sheet 10 to clear the lip 8 of the chute 6, but will not raise the second sheet. To reiterate, however, the precise dimensions are not critical so long as the lateral extent of the protuberance 42 and aperture 19 restrict the pressure gradient along the lateral edges of the stack 7 to a level insufficient to pick up the second sheet. In practice, the ratio of the sum of the areas of the aperture 19 and the rim of the protuberance 42 about the aperture relative to the total area of the wall 9 should be such as to minimize the force pressing the sheet against the rim surrounding the aperture while minimizing the force pressing the sheet against the roller 22 and, hence, the frictional force between the sheet 10 and roller 22.

Referring to FIGS. 11 and 12, it will be further noted that the axis of rotation of roller 22 is skewed slightly in a direction transverse the longitudinal axis of the apparatus 1. By skewing roller 22, side plate 15, as seen in FIG. 2, will also serve as a sheet-guiding surface for aligning and justifying a corresponding edge of each succeeding sheet of paper fed from the machine. Thus, as roller 22 translates sheet 10 in a longitudinal direction, there is also a slight transverse translation imparted to each sheet.

Upon translation of the sheet 10 a predetermined distance, as illustrated in FIG. 1, the sheet is in position to be withdrawn from the apparatus manually or by another machine. In a system employing a facsimile machine, for example, there is typically provided a pick-up roller or the like into which the forward edge of the sheet 10 could be inserted upon the above described translation. Thereafter, in a typical operation, the facsimile machine would withdraw the sheet from the apparatus 1. As the sheet 10 is withdrawn, the aperture 19 is opened. Opening of the aperture reduces the partial differential pressure in the chamber 4. This, in turn, permits wall 9 to fall under the force of gravity into contact with the second sheet on stack 7, thus providing for automatic sequencing of succeeding sheets upon demand.

While described with respect to a preferred embodiment for use in feeding sheets of paper of various sizes, thicknesses, porosity, flexibility and weight, it is understood that the present invention may also be used for the feeding of sheets of cardboard, metallic and plastic material and the like. Various modifications may also be made to the apparatus itself. For example, if the material being fed is too stiff to seal properly about aperture 19, a soft, dense, resilient pad may be employed about the aperture for making a sufficient air seal. In lieu of a solid roller, such as roller 22, a plurality of spaced resilient disc-shaped members may be employed. Similarly, wall 9, instead of being hinged at its rear edge to chamber 4, could be pivotably suspended therefrom by means of a plurality of arms, lever members, rods or the like. If a plurality of arms are used to suspend wall 9, they may be arranged to not only permit wall 9 to move vertically with respect to stack 7, but to move simultaneously in a direction parallel and transverse the longitudinal axis of the stack for imparting the previously described longitudinal and transverse motion to the sheet, thereby eliminating the need for roller 22. Alternatively, the wall 9 may comprise a bellows or diaphragm with a sliding assembly for providing the necessary translation.

It being understood that other modifications and uses will undoubtedly occur to those skilled in the art and may be made by them without departing from the spirit and scope of the present invention, it is intended that the scope of the invention be not limited to the apparatus herein described, but rather viewed as broadly as hereinafter claimed, including the equivalents thereof.

What is claimed is:

1. A sheet-feeding apparatus comprising: means forming a vacuum chamber having at least one movable wall;

an aperture disposed within said movable wall, said movable wall being freely movable to a first position adjacent a top sheet of a stack of sheets;

means for evacuating air from said chamber and drawing said top sheet into contact with said movable wall about said aperture and sealing said aperture, said sealing of said aperture causing a partial differential pressure on opposite surfaces of said movable wall and said top sheet for forcing said movable wall and said top sheet to a second position away from a next adjacent sheet in said stack of sheets;

wherein said movable wall moves freely from said second position to said first position upon a predetermined reduction of said partial differential pressure in said chamber when said top sheet is removed a predetermined amount from said aperture;

means for translating said top sheet in a direction parallel to the longitudinal axis of said stack of sheets; and wherein said translating means comprises means forming a rolling means disposed within said chamber for contacting said top sheet when said top sheet has been moved from said first position to said second position and means coupled to said rolling means for rotating said rolling means and translating said top sheet from said second position to a predetermined third position.

2. An apparatus according to claim 1 further comprising means forming over-running clutch means for permitting removal of said top sheet from said third position to a fourth position by permitting rotation of said rolling means independently of said rotating means.

3. An apparatus according to claim 1 further comprising a sheet-guiding means and means for translating said top sheet in a direction parallel to and transverse the longitudinal axis of said stack of sheets and against said sheet-guiding means upon removal of said top sheet from said stack of sheets, said transverse translation serving to align and justify a corresponding edge of each successive sheet removed from said stack of sheets.

4. An apparatus according to claim 3 wherein said translating means comprises a rolling means disposed within said chamber for contacting said top sheet when said top sheet has been moved from said first position to said second position and means coupled to said rolling means for rotating said rolling means and further wherein the axis of rotation fo said rolling means is skewed relative to said translation in said longitudinal direction for providing said translation in said transverse direction.

5. An apparatus according to claim 1 wherein said movable wall moves automatically from said second position to said first position upon removal of said top sheet from said apparatus and further comprising means forming a sheet-receiving chute terminated by a lip for receiving and containing said stack of sheets in a position wherein said sheets are positioned adjacent said movable wall when said wall moves from its second position to its first position.

6. An apparatus according to claim 5 wherein said sheet-receiving chute is provided with a curved surface interiorly of said lip for bending said stack of sheets and facilitating the separation of said top sheet from said next adjacent second sheet in said stack of sheets.

7. An apparatus according to claim 6 wherein said curved surface of said sheet-receiving chute is concave relative to said movable apertured wall.

8. An apparatus according to claim 7 further comprising means forming a sheet-bending lip extending from a rear edge of said vacuum chamber toward said top sheet of said stack of sheets for contacting and bending said top sheet as said top sheet is moved from said first position on said stack of sheets to said second position, said bending of said top sheet causing a forced distortion of said top sheet which is not passed on to said next adjacent second sheet for further facilitating separation of said top sheet from said second sheet.

9. An apparatus according to claim 1 wherein said movable wall is provided with a downwardly-depending protuberance and said aperture is located in said protuberance.

10. An apparatus according to claim 9 wherein said protuberance and said apertue extend over a predetermined area of said wall with relatively wide margins provided between the corresponding lateral edges of said protuberance and said wall for preventing the separation of more than a single sheet at a time from said stack of sheets.

11. A sheet-feeding apparatus comprising: means forming a sheet-receiving chute for receiving a stack of sheets;

means forming a chamber having a movable wall portion located adjacent said sheet-receiving chute;

means for allowing said movable wall portion to move between a first and a second position;

an aperture located in said movable wall portion;

blower means coupled to said chamber for evacuating air from said chamber and causing a first one of said stack of sheets to close said aperture and move said movable wall portion from said first position to said second position, whereby said first sheet is separated from a next adjacent second sheet in said stack of sheets;

means for translating each sheet removed from said stack of sheets in a first direction;

means for translating each sheet removed from said stack of sheets in a second direction transverse said first direction; and wherein said translating means comprises means disposed within said chamber having a movable friction surface for contacting each sheet removed from said stack of sheets.

12. An apparatus according to claim 11 wherein said means having a movable friction surface comprises a rotatable member and further comprising means responsive to a command signal for rotating said rotatable member.

13. An apparatus according to claim 12 wherein said rotating means comprises a motor coupled to said rotatable member.

14. An apparatus according to claim 13 further comprising means forming an over-running type of clutch mechanism coupling said motor to said rotatable means for allowing rotation of said rotatable means independently of said motor.

15. A sheet-feeding apparatus comprising: means forming a sheet-receiving chute for receiving a stack of sheets;

means forming a chamber having a movable wall portion located adjacent said sheet-receiving chute;

means for allowing said movable wall portion to move between a first and a second position;

an aperture located in said movable wall portion;

blower means coupled to said chamber for evacuating air from said chamber and causing a first one of said stack of sheets to close said aperture and move said movable wall portion from said first position to said second position, whereby said first sheet is separated from a next adjacent second sheet in said stack of sheets; and wherein a first air gap is formed between a sheet removed from said stack of sheets and said movable wall portion which admits air through said aperture when said movable wall portion is in said second position and further wherein said movable wall portion comprises a first planar wall portion and a second wall portion containing said aperture depending from said first planar wall portion for providing a second air gap between a sheet removed from said stack of sheets and said first planar wall portion, whereby air drawn into said chamber through said aperture and said first gap when said movable wall portion is in said second position is insufficient to separate a second adjacent sheet from said stack of sheets.

16. An apparatus according to claim 15 wherein said second wall portion containing said aperture occupies substantially less than the total area of said first planar wall portion for providing relatively wide margins of said first planar wall portion along the lateral edges thereof, said wide margins providing said second air gap.

17. An apparatus according to claim 15 wherein said means for allowing said movable wall portion to move between said first position and said second position comprises means for pivotably coupling said movable wall portion in said chamber.

18. An apparatus according to claim 17 wherein said movable wall portion pivots automatically from said second position to said first position when said aperture is opened to air upon removal of said first sheet therefrom for picking up a second sheet from said stack of sheets.

19. An apparatus according to claim 15 wherein said sheet-receiving chute is curved for bending said stack of sheets and facilitating removal of each sheet individually therefrom.

20. An apparatus according to claim 19 further comprising a sheet-bending lip extending toward said stack of sheets for bending each sheet removed from said stack of sheets as said movable wall portion is moved from said first position to said second position for further facilitating separation of each sheet individually from said stack of sheets.

21. A sheet-feeding apparatus comprising: means forming a sheet-receiving chute for receiving a stack of sheets;

means forming a chamber having a movable wall portion located adjacent said sheet-receiving chute;

means for allowing said movable wall portion to move between a first and a second position;

an aperture located in said movable wall portion;

blower means coupled to said chamber for evacuating air from said chamber and causing a first one of said stack of sheets to close said aperture and move said movable wall portion from said first position to said second position, whereby said first sheet is separated from a next adjacent second sheet in said stack of sheets; and wherein a first air gap is formed and a flow of air occurs between a sheet closing said aperture and a lateral margin of said wall portion about said aperture as said wall portion is moved to its second position and further wherein said wall portion comprises a planar surface and a protuberance containing said aperture depending from a portion of said planar surface for forming a second air gap between said sheet closing said aperture and said planar surface along the lateral edges of said protuberance, said second air gap serving to restrict the air entering said first air gap to that flowing over the surface of said sheet predominantly parallel to the longitudinal axis of said sheet between said sheet and said planar surface for reducing the flow of air into said first air gap from about the lateral edges of said sheet and thereby preventing said latter air flow from separating a second sheet from said stack of sheets.

* * * * *